United States Patent [19]

Anos

[11] 3,965,592

[45] June 29, 1976

[54] ADVERTISING DEVICE

[76] Inventor: Alfredo M. Anos, 6 Anak-Bayan St., San Francisco del Monte, Quezon City, Philippines

[22] Filed: Apr. 11, 1973

[21] Appl. No.: 281,503

[30] Foreign Application Priority Data

Aug. 18, 1971 Philippines ..... 12758

[52] U.S. Cl. ..... 40/28.1

[51] Int. Cl.[2] ..... G09F 27/00

[58] Field of Search ..... 40/28.1, 28.3, 28 R, 40/65, 35, 72, 73.4

[56] References Cited

UNITED STATES PATENTS

| | | | |
|---|---|---|---|
| 2,554,941 | 5/1951 | Dobrowsky | 40/28.1 |
| 2,993,408 | 7/1961 | Cook | 40/28.1 X |

FOREIGN PATENTS OR APPLICATIONS

| | | | |
|---|---|---|---|
| 762,611 | 11/1956 | Canada | 40/73.4 |

*Primary Examiner*—Louis G. Mancene
*Attorney, Agent, or Firm*—Michael J. Striker

[57] ABSTRACT

An advertising device includes a plurality of information-bearing sheets mounted on the periphery of a rotating drum for pivoting about axes which extend parallel to the axis of rotation of the drum. A displaying arrangement holds the successive sheets in substantially vertical positions for a predetermined period of time so as to display the information on such sheets. The drive arrangement for the drum also drives the capstan of a tape recorder so that sound effects are produced which pertain to the then displayed information. The rotation of the capstan is proportionate to the rotation of the drum so that the sounds are synchronized with the visual information.

9 Claims, 7 Drawing Figures

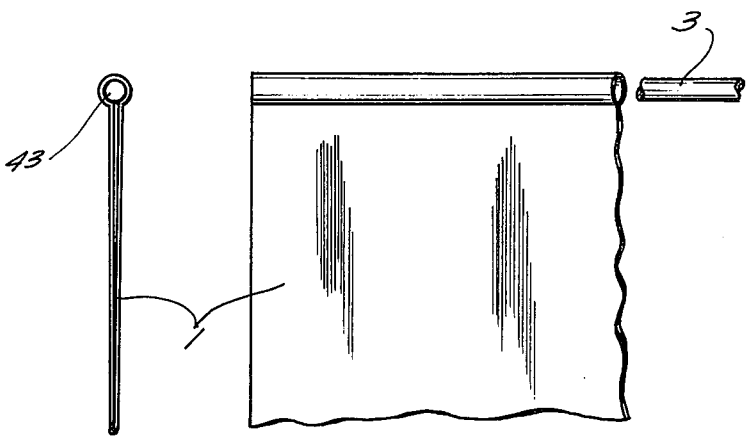
FIG. 6
FIG. 6a
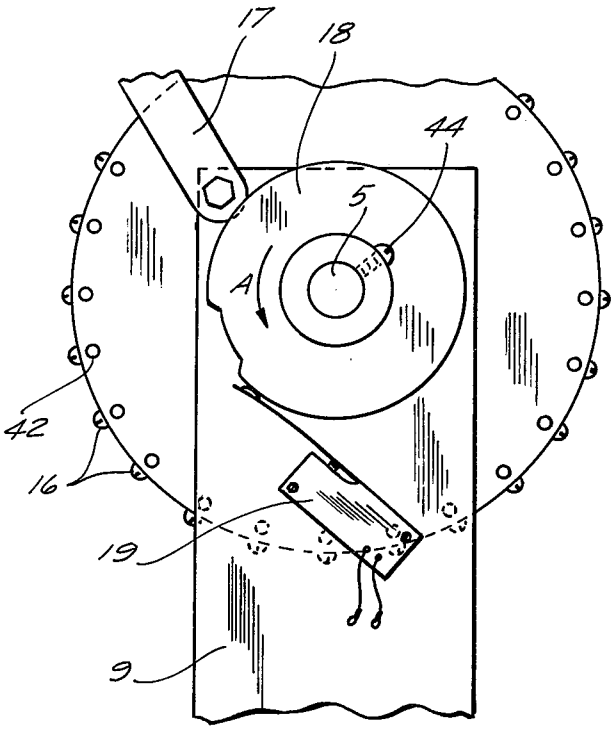
FIG. 5

ADVERTISING DEVICE

This invention is for an advertising device which is capable of displaying successively and automatically a plurality of pictures or illustrations with synchronized sound for every picture or illustration.

This advertising device displays a picture or illustration on a substantially continuous surface with a corresponding sound effects. It is also characterized by having simple and practically trouble free operating mechanism.

The object of this invention is to provide an advertising device which is capable of displaying a plurality of pictures or illustrations with corresponding sound effects.

Another object of this invention is to provide a multi-display advertising device with sound effects which uses a very simple and practically trouble free mechanism.

It is also an object of this invention to provide an advertising device which is very easy to operate and maintain.

A further object of this invention is to provide a multi-display automatic advertising device wherein the displayed pictures or illustrations could be easily replaced.

These objects and others inherent in the novel construction of this invention and the inventive concept thereof will be apparent from the following description of the attached drawings forming part of this specification, wherein;

FIG. 5 is a fragmentary view showing the timing mechanism.

FIG. 6 is a fragmentary view showing in detail the mounting of the illustration bearing aluminum sheet.

Figure 2:
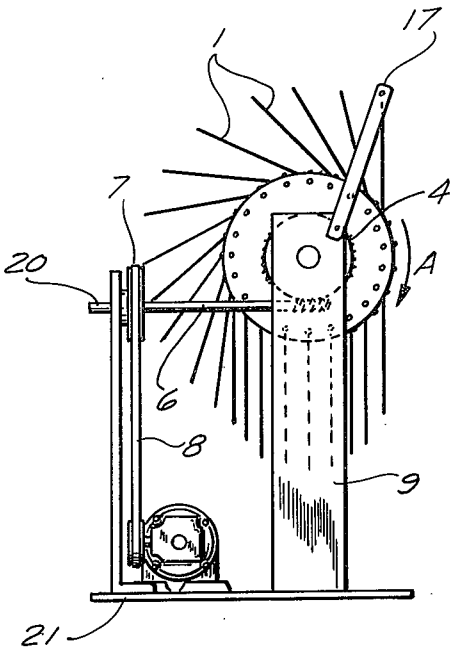
FIG. 2 is a side view thereof.
Figure 1:
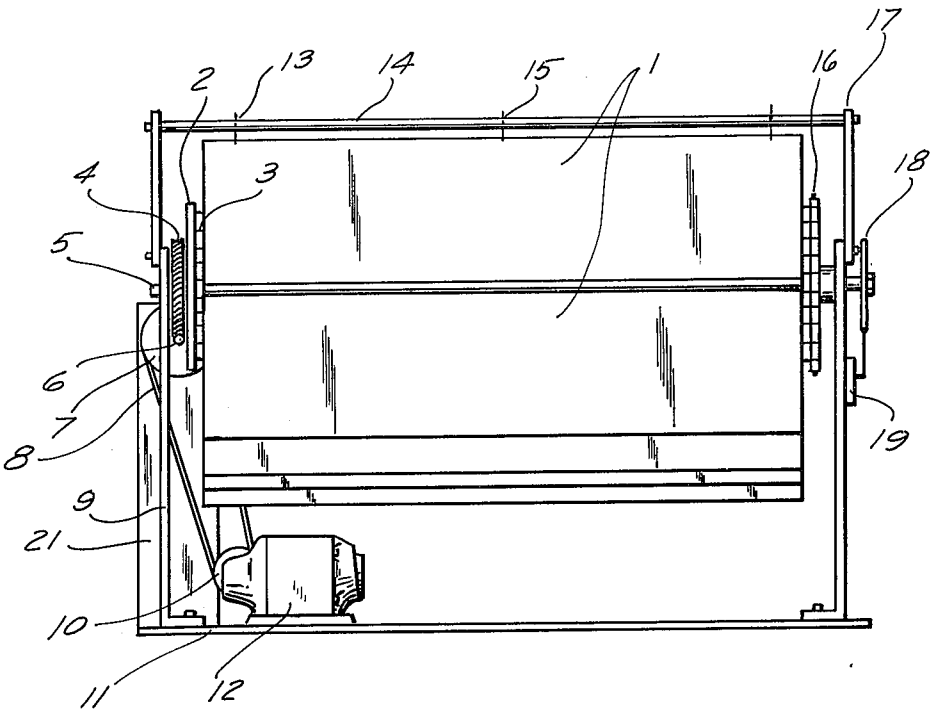
FIG. 1 is a front view of the advertising device as embodied in this invention.

FIG. 6*a* is a side view of the aluminum sheet.

Referring to the drawings, particularly FIGS. 1, 2, 6, and 6*a*, this invention of a multi-display advertising device includes a rotary drum 2 secured to a shaft 5 rotatably mounted on upstanding brackets 9 bolted to a base member 11. On one end of the shaft is secured a gear 4 which meshes with a worm 6 secured to a shaft 20 on which a pulley 7 is also secured. Said pulley 7 is connected by a belt 8 to a drive pulley 10 of a motor 12. A bracket 21 supports the outer end of the shaft 20 while the inner end thereof is supported by a conventional bracket (not shown).

On the periphery of the rotary drum 2 there is mounted a plurality of aluminum display sheets 1 which could include from 20 to 30 pieces, more or less, depending on how many illustrations are to be displayed. On the sides of flanges of the rotary drum 2, there are drilled corresponding opposed holes 42 shown in FIG. 5, which are closed to the circumferential sides of said flanges, the number of holes depending on the desired number of illustrations to be exhibited. In the opposed holes are inserted mounting rods 3 on which eyelets 43 provided at one end of each of the aluminum sheets 1 are loosely mounted so that said aluminum sheets 1 are free to pivot thereon when the rotary drum rotates. The ends of the rods are secured by corresponding set screws 16 screwed into threaded holes drilled in to the rotary drum radially. In actual construction, the rods are closely adjacent to each other so that a very narrow space exists between two adjacent rods. With this arrangement, the illustration displayed on two adjacent aluminum sheets would at a distance appear to be one continuous illustration or picture.

At the upper ends of the opposed brackets 9, there are bolted limiter bar supports 17 the upper ends of which are substantially tilted towards the front of the rotary drum 2. A limiter bar 14 parallel to the axis of the rotary drum 2 is secured to the forwardly tilting upper ends of the opposed support bars 17. On the limiter bar 14 are mounted limiter fingers 13 and 15 which are adapted to hold the aluminum sheets 1 one at a time at a vertical position to display the illustration thereon before each falls down as the rotary drum 2 slowly rotates. The rotary drum 2 rotates at a speed of one or two revolutions per minute.

As shown in FIG. 2, the rotary drum slowly rotates in the direction, of the arrow A and one by one the illustration bearing aluminum sheets 1 are held in a practically vertical position before each falls down to assume a hanging position. An aluminum sheet which has just fallen and the aluminum sheet held by the limiter fingers 13, 15 present a large continuous illustration when viewed from a distance.

To render this advertising device mmore effective, a synchronized sound producing mechanism is provided to play corresponding sound as each illustration is displayed.

Figure 3:
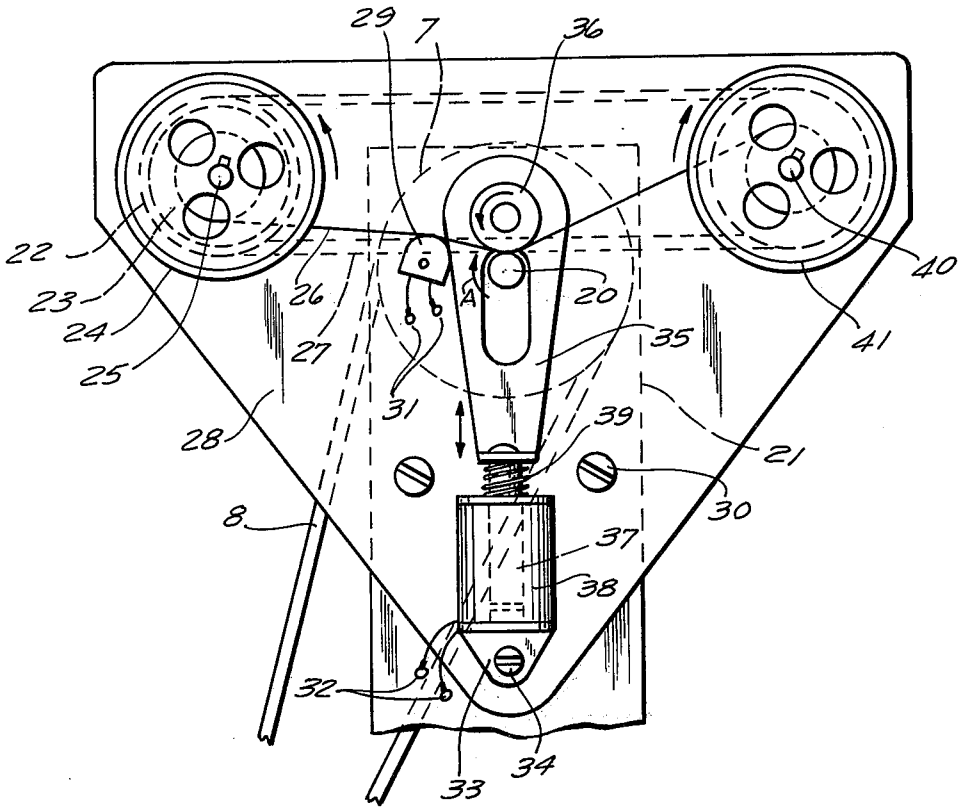
FIG. 3 is a front view of the sound mechanism of this invention of an advertising device.

The sound producing mechanism or system is connected to and operated by an extension of the shaft 20 which rotates continuously in the direction of the arrow A in FIG. 3. The shaft 20 functions as a capstan of a tape recorder. A suitable plate 28 is bolted to a bracket 21 by means of bolts 30. On this plate 28, there are mounted the parts of the sound producing mechanism.

Figure 4:
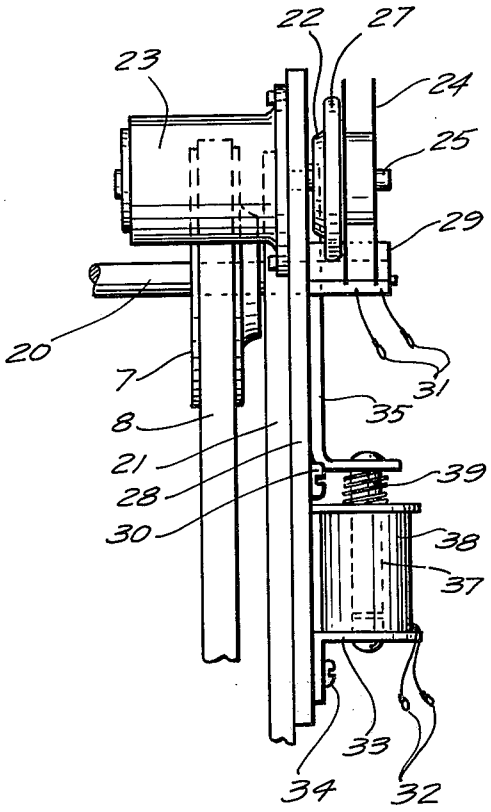
FIG. 4 is a side view of the sound mechanism.

On one side of the plate 28, there is mounted a conventional tape recorder motor 23 shown in FIGS. 3 and 4. On a shaft 25 of said motor 23, there are mounted a slide type pulley or friction clutch 22 and a conventional tape reel or spool 24. Mounted also on the plate 28 and spaced from the spool 24 is a shaft 40 on which are mounted another friction clutch and a tape spool 41. The adjustment of the friction clutch on the shaft 25 is made much stronger than that of the clutch on shaft 40. With this adjustment, the full length of the tape will normally remain reeled or wound on the spool 24 with the other end of the tape remaining secured to the spool 41. When all the tape is reeled on spool 24, both spools 24 and 41 stop rotating.

On plate 28 is secured by bolts 34 a bracket 33 to which a solenoid coil 38 is mounted. The terminals 32 of the solenoid coil are connected to any suitable power source (not shown).

Due to the action of the friction clutch, once the solenoid coil 38 is energized with the help of a timing cam mechanism 18 and a micro-switch 19 to which it is in series connection, a plunger 37 effects the pulling down of a movable arm 35 provided with a loosely mounted rubber pulley 36. Cam 18 is secured to the shaft 5 by a set screw 44. This movement of the movable arm causes the shaft (capstan 20) to engage the tape and forward the same in the direction of the spool 41. During this time with the aid of a belt 27 the tape will be reeled on spool 41 and as the tape slides on the conventional magnetic head 29 sound is reproduced in a conventional amplifier/speaker assembly (not shown) connected with the terminals 31.

When the timing cam 18 switches off the microswitch, the energy of the solenoid coil 38 is cut off and the movable arm 35 is returned due to the action of the spring 39. At this time the tape is free again and spool 24 will reel back the tape and so on.

Various modifications may be made on the above described embodiment of the invention without departing from the essence thereof as defined in the appended claims.

I claim:

1. An advertising device comprising a pair of upright first supports spaced from one another; a drum mounted on said first supports for rotation about a substantially horizontal axis; means for rotating said drum so that successive portions thereof reach a front region of said device which is directed to an observer of the device and including a drive shaft; a plurality of information bearing sheets mounted on said drum for pivoting about axes parallel to the axis of said drum; means for displaying the information on successive sheets momentarily positioned at said front region of said device, said displaying means including a pair of second supports attached to said first supports and extending therefrom to a location above said front region of said drum, and limiting means connected to said second supports and including portions contacting a respective one of said successive sheets and holding the same in a substantially vertical position for a predetermined period of time; a tape recorder operative for reproducing audible signals pertaining to the information displayed by said displaying means and recorded on a magnetic tape, said tape recorder having a capstan connected to said drive shaft so as to share the rotation thereof and adapted to contact the magnetic tape; and means for synchronizing the signals with the information displayed by said displaying means, including a transmission between said drum and said drive shaft operative for establishing a proportion between the rotation of said drive shaft and the rotation of said drum so that said capstan advances the magnetic tape through said tape recorder at a speed proportionate to the speed of rotation of said drum.

2. A device as defined in claim 1; wherein said magnetic tape is stored on a payout reel; and wherein said tape recorder further includes a support shaft for supporting said payout reel, and an additional drive means for rotating said support shaft and said payout reel supported thereon in a direction opposed to the payout direction of said tape.

3. A device as defined in claim 2; wherein said additional drive means includes a friction clutch adapted to permit payout of said tape when said capstan advances the same.

4. A device as defined in claim 3; wherein said magnetic tape is connected to a takeup reel; further including an additional support shaft for supporting said takeup reel; and wherein said additional drive means also rotates said additional support shaft and said takeup reel supported thereon in a direction of takeup of said tape on said takeup reel.

5. A device as defined in claim 4, wherein said tape recorder further includes means for contacting said magnetic tape with said tape so as to advance the latter.

6. A device as defined in claim 5, wherein said contacting means includes a support roller arranged at an opposite side of said tape from said capstant, and means for moving said support roller between an engaging position in which said tape is contacted by said capstan, and a disengaged position.

7. A device as defined in claim 6, said contacting means further comprising an actuating means for moving said support roller between said positions thereof.

8. A device as defined in claim 7, wherein said actuating means includes a solenoid.

9. A device as defined in claim 5, wherein said additional drive means further includes an additional friction clutch adapted to permit takeup of said tape on said takeup reel when said capstan advances said tape and payout of said tape from said takeup reel and its takeup on said payout reel when said capstan is out of contact with said tape.

* * * * *